US005493087A

United States Patent [19]

Yoshida et al.

[11] Patent Number: 5,493,087

[45] Date of Patent: Feb. 20, 1996

[54] OPERATING UNIT FOR A KEY SWITCH

[75] Inventors: Haruo Yoshida, Fujisawa; Yousuke Sakai, Yokohama, both of Japan

[73] Assignee: SMK Co., Ltd., Tokyo, Japan

[21] Appl. No.: 334,381

[22] Filed: Nov. 3, 1994

[30] Foreign Application Priority Data

Dec. 28, 1993 [JP] Japan ..... 5-074936 U

[51] Int. Cl.[6] ..... H01H 13/06

[52] U.S. Cl. ..... 200/302.2; 200/302.1; 200/341; 200/345; 200/512

[58] Field of Search ..... 200/302.2, 302.1, 200/341, 345, 512, 517, 520, 521, 515

[56] References Cited

U.S. PATENT DOCUMENTS 4,527,030 7/1985 Oelsch ..... 200/515

4,806,908 2/1989 Krupnik ..... 200/302.2

*Primary Examiner*—Andres Kashnikow
*Assistant Examiner*—David J. Walczak
*Attorney, Agent, or Firm*—Armstrong, Westerman, Hattori, McLeland & Naughton

[57] ABSTRACT

A key switch operating unit having an elastic cylinder hermetically interposed between the top surface of a housing and the lower surface of a flange portion of a key stem, and a rubber bottom cover covering the lower opening of the housing so as to define an airtight inner space. The housing has an inner partition wall and an outer peripheral wall to define a dust protective space. Small foreign substances such as dust and liquid tending to enter into the inside of the housing when operating the key switch can be prevented from entering.

2 Claims, 3 Drawing Sheets

OPERATING UNIT FOR A KEY SWITCH

BACKGROUND OF THE INVENTION

1. Field of the Invention

This invention relates to an operating unit for a key switch incorporated in a key board used as various information inputting means in a point-of-sale (POS) terminal, electronic cash register equipment (ECE) or the like.

1. Description of the Prior Art

There has been so far used widely a key switch in a key board, which has a structure as shown in FIG. 1. The key switch is retained in a mounting hole 2 formed in a metallic support frame 1 by fitting a key switch operating unit 3 into the mounting hole 2 so as to permit the on-off operation of a contact membrane 4. The operating unit 3 is detachably supported on the support frame 1 by means of spring pieces 6 having engaging claws integrally formed on the outside of a housing 5. Within the housing 5, a key stem 7 is guided movably in the vertical direction by a guide cylinder 8 and upwardly urged by a return spring 9. The lower surface of the key stem 7 is opposite to the upper surface of a rubber member 11. Between the key stem 7 and the rubber member 11, a switch pressure spring 10 is interposed. The rubber member 11 is fitted into the lower part of the housing 5 and has a contact pressing protrusion 12 extending downward from at the central portion of the lower surface thereof. A key top 13 is placed on the upper end of the key stem 7.

By pressing down the key top 13, the key stem 7 is moved downward against the return spring 9 so as to push down the contact pressing protrusion 12 of the rubber member 11 through the medium of the switch pressure spring 10, thus depressing the contact membrane 4 to make electrical contact.

Since the conventional key switch operating unit as mentioned above has a clearance gap inevitably formed between the guide cylinder of the housing and the key stem, dust and liquid are permitted to enter into the inside of the key switch in keying, consequently giving rise to increase in sliding resistance, and when the worst comes to the worst, the key switch ceases to function.

Thus, the idea that the housing is closed up tightly to prevent the air from entering into the inside thereof can be considered. However, the key switch in the closed housing having a small internal space entails problem such as difficulty in providing a smooth keying operation. Moreover, the internal pressure in the housing is disadvantageously increased when pressing down the key. Accordingly, there is a possibility that the air increased in pressure may escape out of the housing, thus causing the internal pressure in the housing to be decreased when the key is turned back by the return spring 9. As a result, the key may be possibly prevented from returning in situ.

OBJECT OF THE INVENTION

This invention is made to eliminate the drawbacks suffered by the conventional key switch operating unit as described above and has an object to provide a high-performance operating unit for a key switch, which can allow air to flow in and out from the inside of a key housing when pressing down and returning a key, while perfectly preventing dust and liquid from entering into the inside of the key housing.

SUMMARY OF THE INVENTION

To attain the object described above according to this invention, there is provided an operating unit for a key switch, comprising a housing to be fitted to a support frame, which has a guiding hole vertically bored for a cylindrical key stem with a slide shaft so as to permit the slide shaft to slide in the axis direction, an elastic member for urging the key stem upward, a contact pressure member for moving downward a switch contact when pressing down the key stem, an elastic cylinder made of elastic material such as rubber and placed between the top portion of the housing and the flange portion formed on the upper end portion of the key stem, a bottom cover made of elastic material such as rubber for closing the lower opening of the housing to define an airtight internal space in the housing and provided at the central portion of the lower surface thereof with a contact pressing member to be urged downward by a pressure portion formed at the lower end of the key stem, wherein a dust protective space is formed between the outer peripheral wall of the housing and an inner partition wall, an outer wall air vent hole communicating with the dust protective space is formed in the outer peripheral wall of the housing, and a partition wall air vent hole communicating with the inside of the housing is formed in the inner partition wall apart from the aforesaid outer wall air vent hole.

The dust protective space is closed with the bottom cover covering the lower opening of the housing. The bottom cover has projections inserted into the dust protective space so as to form a zigzag-shaped air passage through the outer wall air vent hole and partition wall air vent hole.

By pressing down the key stem against the elastic cylinder, the central portion of the rubber bottom cover is pushed by the lower end of the key stem and bent downward to thrust the contact pressing member toward the switch contact. When the pressing force exerted to the key stem is released, the key stem is push up in situ by the elasticity of the elastic cylinder. Thus, the on-off switching operation is performed. During the switching operation, the internal pressure in the housing changes with the vertical movement of the key stem because the upper opening is closed with the elastic cylinder and the lower part of the housing is closed with the bottom cover so as to make the inside of the housing airtight. Thus, when moving the key stem vertically, the air flows in and out from the inside of the housing through the outer wall air vent hole, dust protective space and partition wall air vent hole. Small foreign substances such as dust and liquid which tend to enter into the housing through the air vent holes when moving the key up and down can be prevented from entering into the inside of the housing by means of the zigzag-shaped air passage constituted by the air vent holes, thus permitting the key stem to slide smoothly.

Furthermore, since the projections on the bottom cover thrust into the dust protective space makes the air passage zigzag, small foreign substances such as dust, which enter into the inside of the housing along with air admitted through the air passage when pressing the key stem, run off the air passage and are separated from the air flowing into the inside of the housing by the action of the inertia thereof when passing through the corners of the zigzag air passage, because the small foreign substances such as dust are usually larger in specific gravity than the air. As a result, the foreign substances are prevented from entering into the central portion of the housing and fall to the bottom cover.

Since the push-down motion imparted to the key by an operator is generally more quick than the return motion for elastically returning the key in situ, the small foreign substances entering into the dust protective space along with the intake air are discharged out of the dust protective space with the air flowing backward when the pushed-down key returns.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

The present invention will become more fully understood from the detailed description given hereinbelow and the accompanying drawings which are given by way of illustration only, and thus are not limitative of the present invention.

Figure 1:
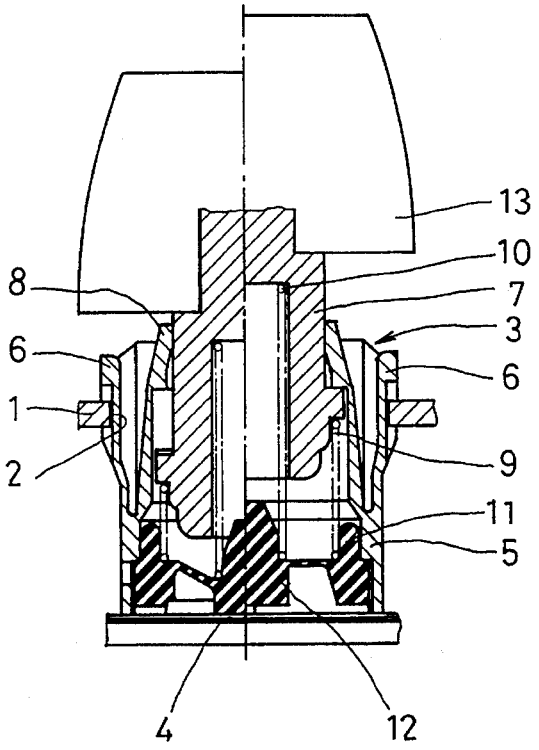
FIG. 1 Prior Art
FIG. 1 is a longitudinal sectional view of a prior art key switch, showing the steady state thereof in the right half and the push-down state thereof in the left half.
Figure 2:
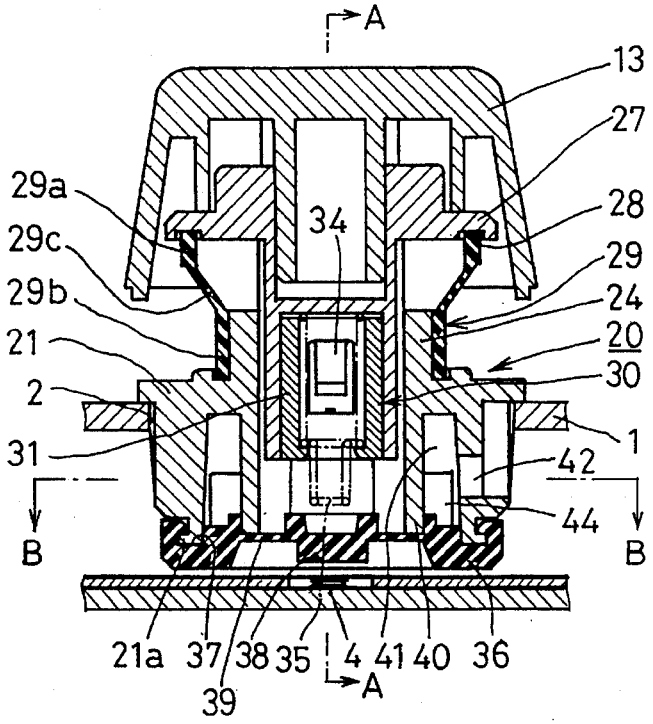
FIG. 2 is a longitudinal sectional view of one embodiment of a key switch using a key switch operating unit according to the present invention.
Figure 3:
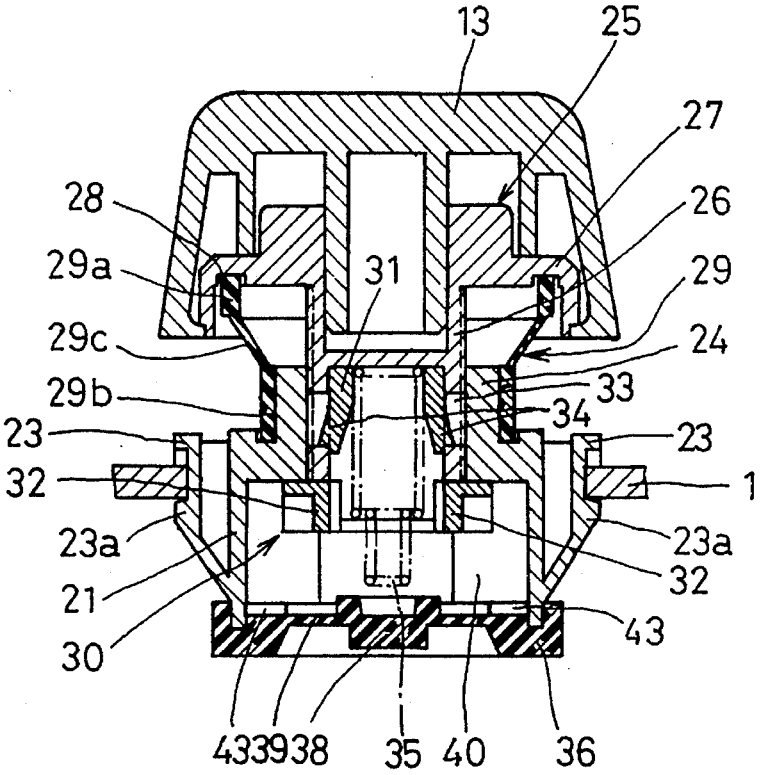
FIG. 3 is a section taken on line A—A in FIG. 2.
Figure 4:
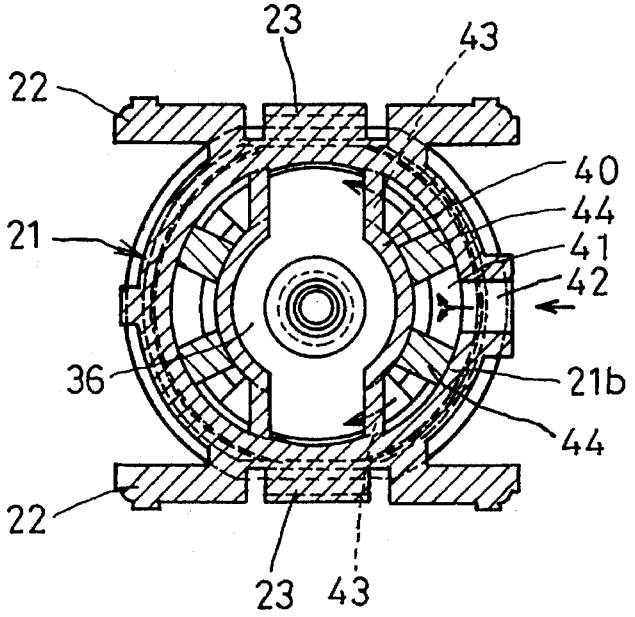
FIG. 4 is a section taken on line B—B in FIG. 2.
Figure 5:
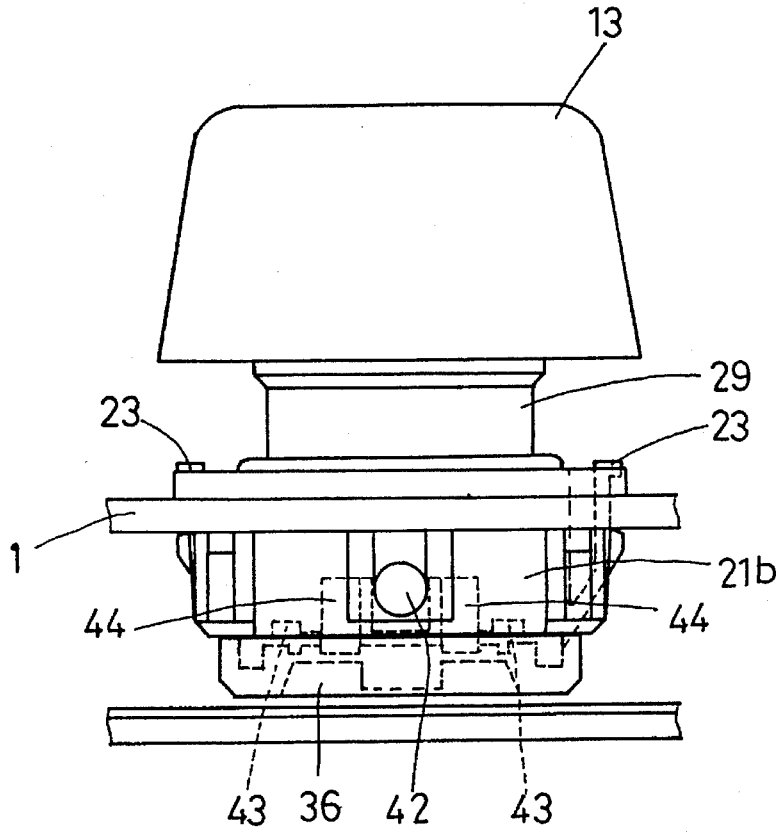
FIG. 5 is a front view of the embodiment of FIG. 2.
Figure 6:
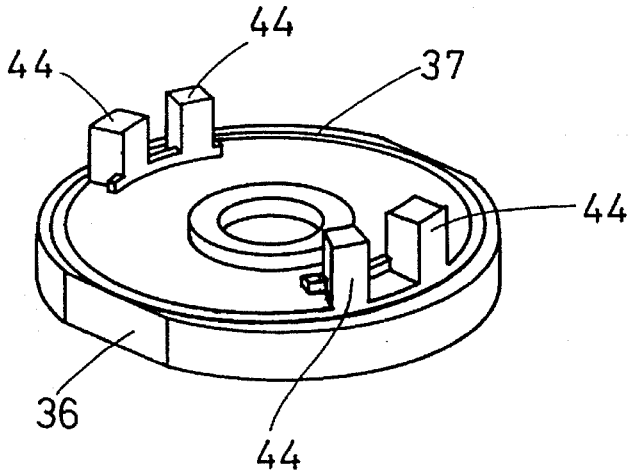
FIG. 6 is a perspective view of a bottom cover provided in the key switch operating unit of this invention.

One preferred embodiment of the present invention will be described hereinafter with reference to FIG. 2 through FIG. 6.

In the drawings, reference numeral 20 denotes a key switch operating unit according to this invention. This key switch operating unit 20 is fitted into a mounting hole 2 bored in a metallic support frame 1 and has a bottom opposite to a contact membrane 4.

The operating unit 20 has a housing 21 formed by molding. The housing 21 is shaped in a cylinder and has blankets 22 tangentially extending in parallel with each other. Formed on the central portion of each blanket 22 is a spring piece 23 having an engaging claw 23*a*. The engaging claw 23*a* of the spring piece 23 is engaged with the lower edge of the aforementioned mounting hole 2 so as to inextricably retain the housing 21 on the support frame.

Integrally molded on the upper surface of the housing 21 is a guide cylinder 24 into which a slide shaft 26 of a key stem 25 is inserted movably in the axial direction thereof. The key stem 25 has a cap-shaped circular flange portion 27 integrally molded on the upper end of the slide shaft 26. Supported by the outer periphery of the flange portion 27 is a key top 13. The lower surface of the flange portion 27 has a circular fitting groove 28 concentric with the slide shaft 26. Between the groove 28 and the outer peripheral surface of the guide cylinder 24 on the housing, there is interposed an elastic cylinder 29 to define an airtight space between the guide cylinder 24 and the flange portion 27.

The elastic cylinder 29 is made of elastic rubber and comprises a large diameter cylindrical portion 29*a*, a small diameter cylindrical portion 29*b*, and a tapered cylindrical portion 29*c* between the portions 29*a* and 29*b*. The large diameter cylindrical portion 29*a* is fitted into the circular groove 28 formed in the lower surface of the flange portion 27. The small diameter cylindrical portion 29*b* is in close contact with the outer peripheral surface of the guide cylinder 24. The tapered cylindrical portion 29*c* is elastically deformed so as to cause perceivable click sensation when pressing down the key stem 25, and resumes its original steady shape when releasing the push-down force imparted to the key stem.

Arranged beneath the lower end of the slide shaft 26 of the key stem 25 is a stopper piece 30 comprising a cylindrical portion 31 inserted in the slide shaft 26, a pair of stopper projections 32 extending downward from the lower end of the slide shaft 26, and engaging spring pieces 34 to be engaged with engaging windows 33 bored in the side wall of the slide shaft. Disposed inside the cylindrical portion 31 is a coil spring 35 for exerting a switching pressure on the switch contacts.

The lower end of the housing 21 is hermetically closed with a rubber bottom cover 36. In the peripheral portion of the upper surface of the bottom cover 36, there is formed a fitting groove 37 for receiving the lower end of the housing 21 and the flange 21*a*.

The bottom cover 36 has a contact pressing member 38 on the central portion thereof and a thin elastic portion 39 around the contact pressing member 38.

Inside the housing 21, there are formed inner partition walls 40 surrounding a sliding space for permitting the movements of the slide shaft 26 of the key stem 25 and the stopper projections 32 of the stopper piece 30. Defined between one of the partition walls 40 and the outer peripheral wall 21*b* of the housing is a dust protective space 41. In the wall 21*b*, an outer wall air vent hole 42 is formed at the level substantially half the height of the central portion of the dust protective space 41 to open the space 41 to the air. Formed in the lower part of the inner partition wall 40 are notch-like air vent holes 43 communicating with the central space of the housing.

The dust protective space 41 has a lower opening hermetically closed with the aforesaid bottom cover 36. The bottom cover 36 is provided on its upper surface with a pair of projections 44. The projections 44 are inserted into the space 41 until the upper ends thereof reach the hole 42, and placed on both sides of the hole 42 in the space 41. Owing to these projections 44, the air passage from the outer wall air vent hole 42 to the air vent hole 43 is bent up and down in a zigzag form.

As described above, in the key switch operating unit thus constructed, the upper opening of the housing 21 is airtightly closed with the elastic cylinder 29, and the lower opening thereof is airtightly closed with the bottom cover 36. By pressing down the key top 13, the key stem 25 is moved down against the elastic cylinder 29 to push down the contact pressing member 38 of the bottom cover 36 by the coil spring 35 of the lower end of the slide shaft 26, thus turning the contact membrane 4 into its ON state. By releasing the pressing force exerted to the key top 13, the key stem is elastically returned in situ by the elastic cylinder 29.

Moreover, since the upper and lower openings of the housing 21 are airtightly closed with the elastic cylinder 29 and the bottom cover 36, the internal pressure in the housing varies with the vertical motion of the key stem 25 to permit the air to flow into and out through the air vent holes 42 and 43 and the dust protective space 41. Small foreign substances such as dust entering into the dust protective space 41 together with the air flowing thereinto are seized and accumulated on the bottom of the space 41 between the projections 44, and partially discharged with the air flowing out when pressing down the key stem.

As is apparent from the foregoing description, according to the key switch operating unit of the present invention, in which the upper opening of the housing is airtightly closed with the elastic cylinder which is disposed between the housing and the key stem and serves as a returning spring means for the key stem, and the lower opening of the housing is airtightly closed with the bottom cover, while forming the air vent holes for permitting the air to flow in and out, the dust protective space can be formed to collect the small foreign substances such as dust, which tends to enter into the inside of the housing along with the air flowing thereinto when the key stem returns, thus preventing the foreign substances from entering beyond the dust protective space.

Furthermore, since the projections on the bottom cover are inserted into the dust protective space to bend the air passage up and down in a zigzag form, the foreign substances can be more effectively prevented from entering into the inside of the housing.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A key switch operating unit, comprising:

a cylindrical key stem having a slide shaft, an upper flange portion, and a lower end;

a housing to be fitted to a support frame, said housing including a guiding hole vertically oriented therein for receiving said slide shaft of said cylindrical key stem to enable said slide shaft to slide in its axis direction within said guiding hole; said housing having a lower partition wall extending downwardly from said housing a lower flange portion extending downwardly from said housing, and a lower opening defined by a lowermost end of said lower flange portion, a contact pressure member disposed within said housing, said contact pressure member being actuated by downward movement of said key stem;

an elastic cylinder composed of elastic material and disposed between said housing and said upper flange portion of said key stem for urging said key stem upward when said key stem is depressed;

a bottom cover composed of elastic material for closing said lower opening of said housing to define a first airtight internal space in said housing which is between the lower flange portion and an outer surface of said lower partition wall and is bounded by said bottom cover, and a second internal space which is enclosed by an inner surface of said lower partition wall and said bottom cover, said bottom cover having a lower central portion with a contact pressing member which can be urged downward by said pressure member such that said first airtight internal space forms a dust protective space;

said housing having a first, outer wall air vent hole disposed in the lower flange portion such that said air vent hole communicates with said dust protective space, and said lower partition wall having a second air vent hole communicating with said second internal space inside of said housing, said second air vent hole being disposed in said lower partition wall.

2. A key switch operating unit according to claim 1, wherein said bottom cover has projections which extend into said dust protective space so as to form a zigzag-shaped air passage through said first, outer wall air vent hole and said second air vent hole.

* * * * *